United States Patent [19]

Duffy

[11] 4,021,676

[45] May 3, 1977

[54] WASTE CANISTER FOR STORAGE OF NUCLEAR WASTES

[75] Inventor: James B. Duffy, Fullerton, Calif.

[73] Assignee: The United States of America as represented by the United States Energy Research and Development Administration, Washington, D.C.

[22] Filed: May 7, 1976

[21] Appl. No.: 684,421

[52] U.S. Cl. ..... 250/506; 165/179; 250/507; 252/301.1 W; 252/301.15

[51] Int. Cl.[2] ..... G21F 5/00

[58] Field of Search ..... 252/301.1 W, 301.15; 250/506, 507; 176/81; 165/179

[56] References Cited

UNITED STATES PATENTS

| | | | |
|---|---|---|---|
| 3,005,105 | 10/1961 | Lusk | 250/506 |
| 3,092,565 | 6/1963 | Williams et al. | 176/81 |
| 3,282,335 | 11/1966 | Haller | 176/81 |
| 3,365,578 | 1/1968 | Grover et al. | 252/301.1 W |
| 3,369,972 | 2/1968 | Seymour | 176/81 |
| 3,610,334 | 10/1971 | Sletter | 250/507 |
| 3,727,060 | 4/1973 | Blum | 250/506 |
| 3,780,309 | 12/1973 | Bochard | 250/507 |

OTHER PUBLICATIONS

Watson, L. C. et al, "The Disposal of Fission Products in Glass" Proceedings of the 2nd U.N. Int'l. Conf. on Peaceful Use of Atomic Energy (1958) pp. 19–26 of vol. 18.

*Primary Examiner*—Richard E. Schafer
*Assistant Examiner*—Deborah L. Kyle
*Attorney, Agent, or Firm*—Dean E. Carlson; Arthur A. Churm; Frank H. Jackson

[57] ABSTRACT

A waste canister for storage of nuclear wastes in the form of a solidified glass includes fins supported from the center with the tips of the fins spaced away from the wall to conduct heat away from the center without producing unacceptable hot spots in the canister wall.

4 Claims, 4 Drawing Figures

WASTE CANISTER FOR STORAGE OF NUCLEAR WASTES

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

This invention relates to a storage canister of radioactive wastes. In more detail, the invention relates to a storage canister for storing radioactive wastes which have been solidified as a glass.

It has been proposed that high-level, long-half-life radioactive wastes be converted to a glass and stored within a container or canister in some location where the radioactivity cannot contaminate the environment. Conversion of the wastes to a glass is advantageous because of the great inertness and low solubility of a glass. However, a glassy waste has a very low thermal conductivity and a high heat generation rate. This combination causes very high centerline temperatures when the waste is stored in a cylindrical canister. An obvious solution to the problem would be to employ fins extending from the canister wall to the canister center to conduct the heat from the center of the canister to the walls. Unfortunately, such a simple solution to the problem is not practical since conventional fins produce local hot spots where they are attached to the wall of the canister. Such hot spots cannot be tolerated as they induce severe internal stresses in the canister.

SUMMARY OF THE INVENTION

Surprisingly, I have discovered that fins centered in the canister so that the ends of the fins are spaced from the canister wall are effective to keep the centerline temperature in the glass filling the canister at an acceptable level without producing unacceptable hot spots in the canister wall. While the amount of clearance has not been optimized, a one-half-inch gap would be suitable for a canister 12 inches in diameter having one-sixteenth inch walls formed of stainless steel. For canisters of differing sizes, wall thickness and wall material gaps of one-eighth to five-eighths inches would be suitable.

DESCRIPTION OF A SPECIFIC EMBODIMENT OF THE INVENTION

Figure 1:
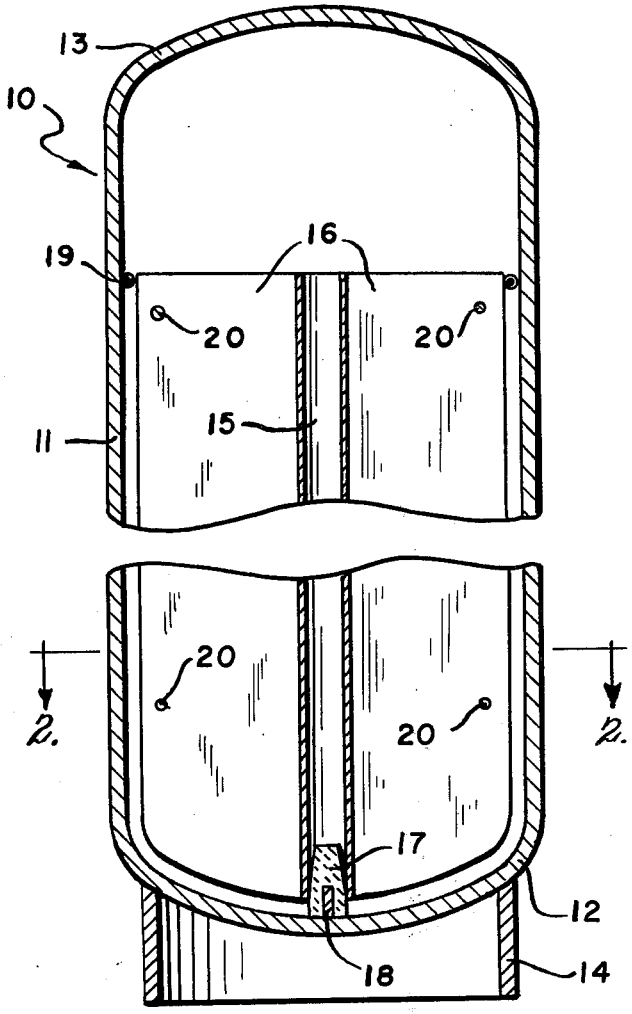
FIG. 1 is a vertical section of a storage canister according to the present invention.
Figure 2:
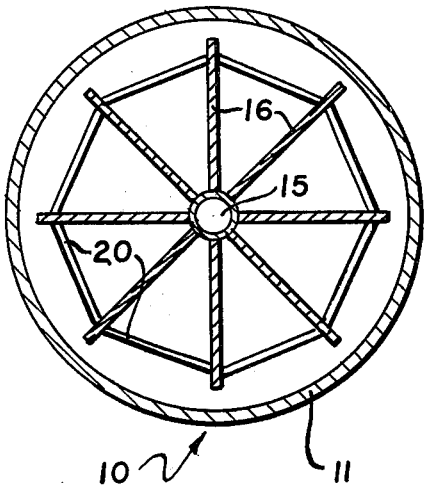
FIG. 2 is a horizontal section taken on the line 2—2 of FIG. 1.

As shown, a waste canister 10 according to the present invention includes a cylindrical side wall 11 and upper and lower end caps 12 and 13 respectively and rests in a vertical position on support 14. To contact heat from the center of the canister to the wall, the canister contains a fin assembly consisting of a 1 inch diameter pipe 15 to which are welded eight fins 16 at 45° intervals. The end of pipe 15 fits over ceramic conical standoff 17 which is tied to the bottom end cap 13 of the canister at the center thereof by pin 18. The lower ends of the fins 16 are shaped to conform to the shape of the end cap 13 of the canister 10, the standoff spacing the fins away therefrom. The fins 16 terminate at a point near the top of the side wall 11 of the canister and are spaced therefrom at the top by short spacer rods 19 tacked to the edge of the fins near the top thereof. Reinforcing rods 20 extend between adjacent fins as staggered locations.

According to one specific embodiment of the invention, canister 10 is formed from a one sixteenth inch thick schedule 40, stainless steel pipe provided with top and bottom end caps. Stainless steel fins 16 are spaced from the side wall and lower end cap of the canister to provide a ½ inch gap therebetween, the fins being one fourth inch thick.

Figure 3:
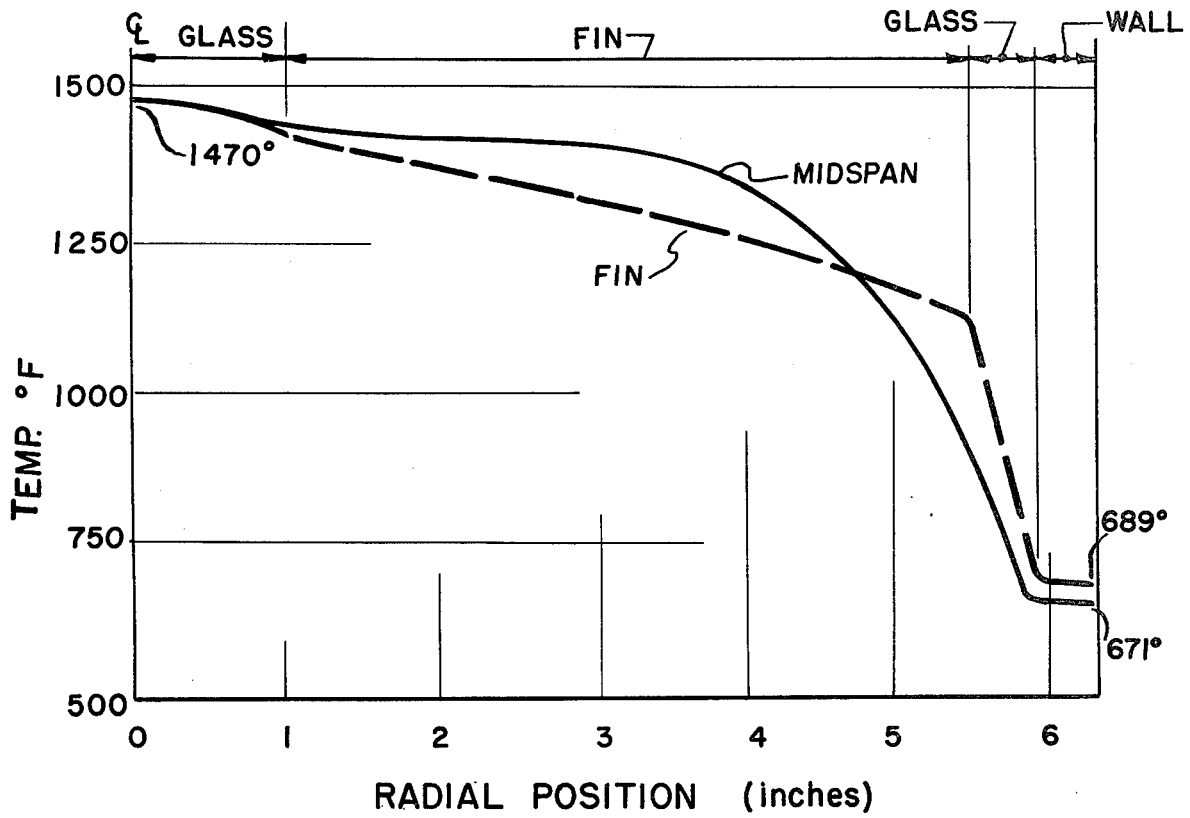
FIG. 3 is a graph comparing the temperature distribution at a point on the fins with a point half-way between fins (midspan) in a 12-inch canister having 8 fins at 45° intervals in which the fins terminate one half inch from the canister wall.
Figure 4:
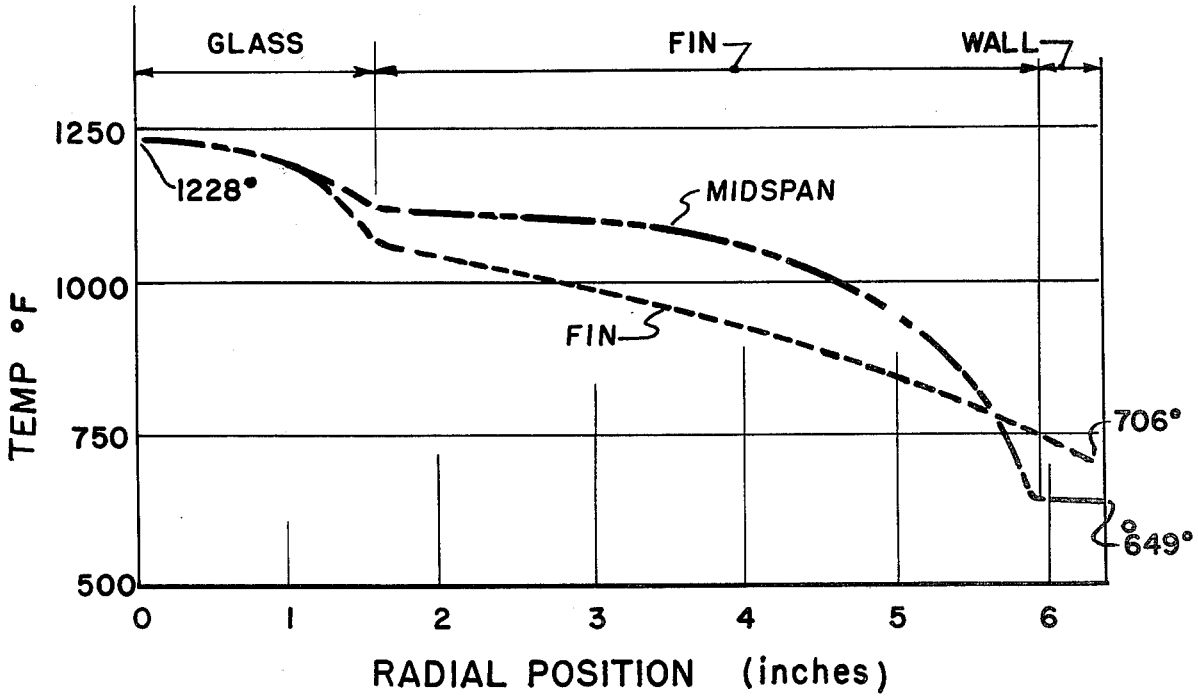
FIG. 4 is a graph comparing the temperature distribution at a point on the fins with a point half-way between fins (midspan) in a 12-inch canister having 8 fins at 45° intervals attached to the canister wall.

The graphs show the advantageous results attained by the present invention. It will be noted from FIG. 4 that the temperature at the canister wall where a fin is attached is 706° F while the temperature at midspan between fins at the canister wall is 649° F. This temperature difference of 57° F cannot be tolerated. On the other hand, as shown in FIG. 3, the temperature at the canister wall closest to the end of a fin arranged in accordance with the present invention is 689° F whereas the midspan temperature at the canister wall is 671° F for a temperature difference of only 18° F. The temperature at the center has gone up from 1228° to 1470° F. This can be tolerated. It will be noted that the theoretical analysis on which the graphs are based presumes that the center of the canister is filled with glass, whereas according to the preferred embodiment of the invention as shown by FIG. 1 this space is filled by pipe 15. Obviously the glass temperature near the center of the canister will be lower when pipe 15 is present than it would be if the center of the canister were completely filled with glass.

The space between the fin and the wall becomes filled with glass waste which insulates the edge of the fin from the canister wall. Surprisingly, this insulation does not destroy the fin performance. Thus, employing fins as suggested herein causes a 70% drop in the local hot spot temperature difference and yet results in only a 20% rise in centerline temperatures and a 3% rise in canister wall temperatures.

The actual offset or distance between the end of the fin and the canister wall is, of course, a variable which may be adjusted to suit particular conditions. That distance given above, while not necessarily optimum, will give satisfactory results. For canisters of different sizes, wall thickness and wall material, gaps of one eighth inch to five eighths inch would be suitable.

Additional advantages arising from the present invention are 1) the fin-wall gap allows even filling of the canister by permitting the molten glass at the outer edges to flow around the fins into the adjacent section, 2) since the fins are not rigidly fixed to the canister walls, they are not too restricted during thermal cycles and thus the thermal strains do not cause much fin distortion, 3) the assembly may be preassembled and merely dropped into place in the canister, thereby reducing installation and construction labor costs.

The embodiments of the invention in which an exclusive property or privilege is claimed are defined as follows:

1. A storage canister containng radioactive nuclear wastes in the form of a glass, radioactive isotopes being present therein in concentration sufficient to produce a large amount of heat, said canister comprising a canister body consisting of a side wall and top and bottom end caps, and a fin assembly disposed in the canister body, the fins extending from the center of the canister to a point spaced from the canister wall a distance effective to keep the temperature of the glass at the center of the canister at an acceptable level without producing unacceptable hot spots in the canister wall, the space between the end of the fin and the wall being filled with glass to provide thermal insulation between the fin and the wall.

2. A storage canister according to claim 1 wherein the fin assembly includes a pipe disposed on the axial center line of the canister body having eight fins radiating therefrom at 45° intervals and extending from a point near the top of the canister to the bottom of the canister.

3. A storage canister according to claim 2 and including a conical, ceramic standoff attached to the center of the lower end cap of the canister and over which the end of the central pipe fits and spacer rods tack welded to the outer edge of the fins near the top thereof to space the fins the desired distance away from the side wall of the canister.

4. A storage canister according to claim 3 wherein the canister body, central pipe and fins are formed of stainless steel, the canister is 12 inches in diameter, the canister body is one sixteenth inch thick, and the fins are one fourth inch thick and terminate one half inch away from the side walls of the canister.

* * * * *